United States Patent [19]

Larsson et al.

[11] Patent Number: 4,618,964

[45] Date of Patent: Oct. 21, 1986

[54] LADLE OR TUNDISH

[75] Inventors: Hans G. Larsson; Erik Westman, both of Västerås; Artur Ostlund, Linkoping, all of Sweden

[73] Assignee: Asea AB, Västerås, Sweden

[21] Appl. No.: 698,447

[22] Filed: Feb. 5, 1985

[30] Foreign Application Priority Data

Feb. 6, 1984 [SE] Sweden ..... 8400586

[51] Int. Cl.[4] ..... H05B 5/16

[52] U.S. Cl. ..... 373/155

[58] Field of Search ..... 373/151–158

[56] References Cited

U.S. PATENT DOCUMENTS 4,123,045 10/1978 Michelet et al. ..... 373/156

*Primary Examiner*—Roy N. Envall, Jr.

*Attorney, Agent, or Firm*—Kenyon & Kenyon

[57] ABSTRACT

A ladle or tundish has a side wall comprising a refractory lining adapted to be contacted by molten metal, and a concrete wall surrounding the lining and reinforced by metal wires, the side wall being free from a metal shell. Therefore the side wall is relatively permeable to the field of an induction heating coil on the outside of the side wall.

7 Claims, 6 Drawing Figures

LADLE OR TUNDISH

BACKGROUND OF THE INVENTION

A steel ladle functions as a normally portable container for a molten steel melt. The ladle comprises a steel shell lined with a refractory lining for containing the melt. The melt can be stirred by multi-phase electromagnetic stirrers positioned on the outside of the side wall of the ladle, in which case the steel shell is normally made of a non-magnetic steel.

However, if instead of stirring only, it is desired to electrically inductively heat the melt in the ladle there is a problem connected with using the conventional single-phase coil on the outside of the side wall and powered by single-phase AC having a frequency of from 50 to 60 c.p.s. When this is attempted the steel shell wall is also inductively heated, reducing the field intended to heat the melt and causing excessive heating of the ladle shell.

The steel melt is sometimes fed from the ladle into a tundish from which it feeds into a casting mold, and where applicable the term "ladle" can mean a tundish as an equivalent. Also, other metal melts may be considered an equivalent to a steel melt.

BRIEF SUMMARY OF THE INVENTION

According to the present invention the ladle is made without a steel wall but instead one which is made of metal wire reinforced concrete. The wires extend vertically and a steel ring encircles the top or rim of this wall and the upper ends of the reinforcing wires are fixed to this ring. The ladle bottom is also formed by metal but the bottom ends of the wires can be left free from this part so as to avoid the formation of possible electrically conductive loops. The wire reinforced non-metallic shell wall supports the side wall of the lining of the container without being in the way of the inductive heating field projected through the side wall and into the melt in the ladle. Other details of the invention are disclosed hereinafter.

DESCRIPTION OF THE DRAWINGS

In the accompanying schematic drawings the various figures are as follows.

DETAILED DESCRIPTION OF THE INVENTION

Figure 1:
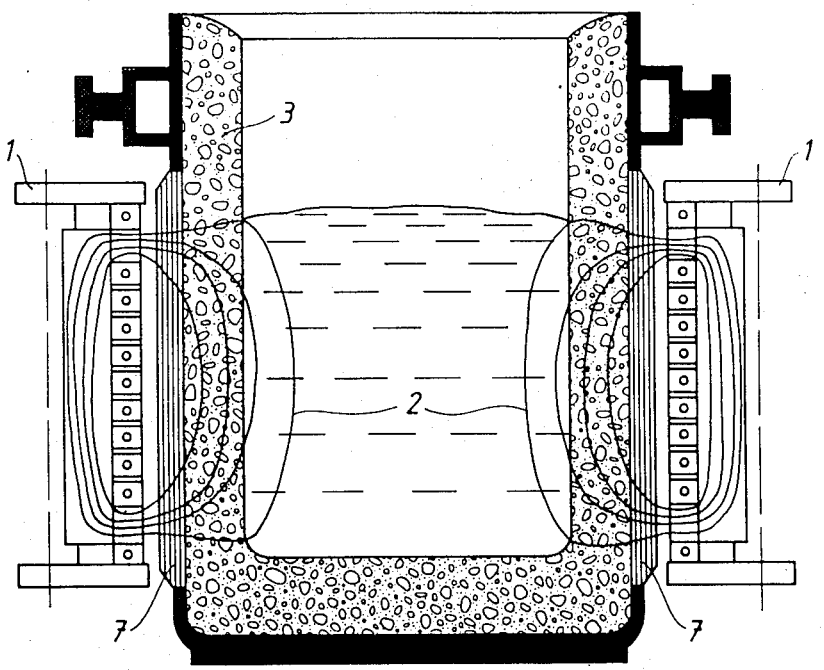
FIG. 1 is a vertical section showing a ladle embodying the invention.

In the above drawings FIG. 1 shows a ladle having its wall surrounded by an induction heating coil 1 which when supplied with single-phase mains frequency AC, 50 or 60 c.p.s., projects its field 2 into a melt in the ladle, for heating the melt. The ladle has the usual refractory and heat-insulating lining 3. However, it does not have the usual metal shell wall.

Instead, the wall of the ladle lining is encircled by a wall 7 comprising a metal reinforced concrete wall. The word concrete is intended to embrace a ceramic or ceramic compound material and the like possibly reinforced by glass fibers.

Figure 2:
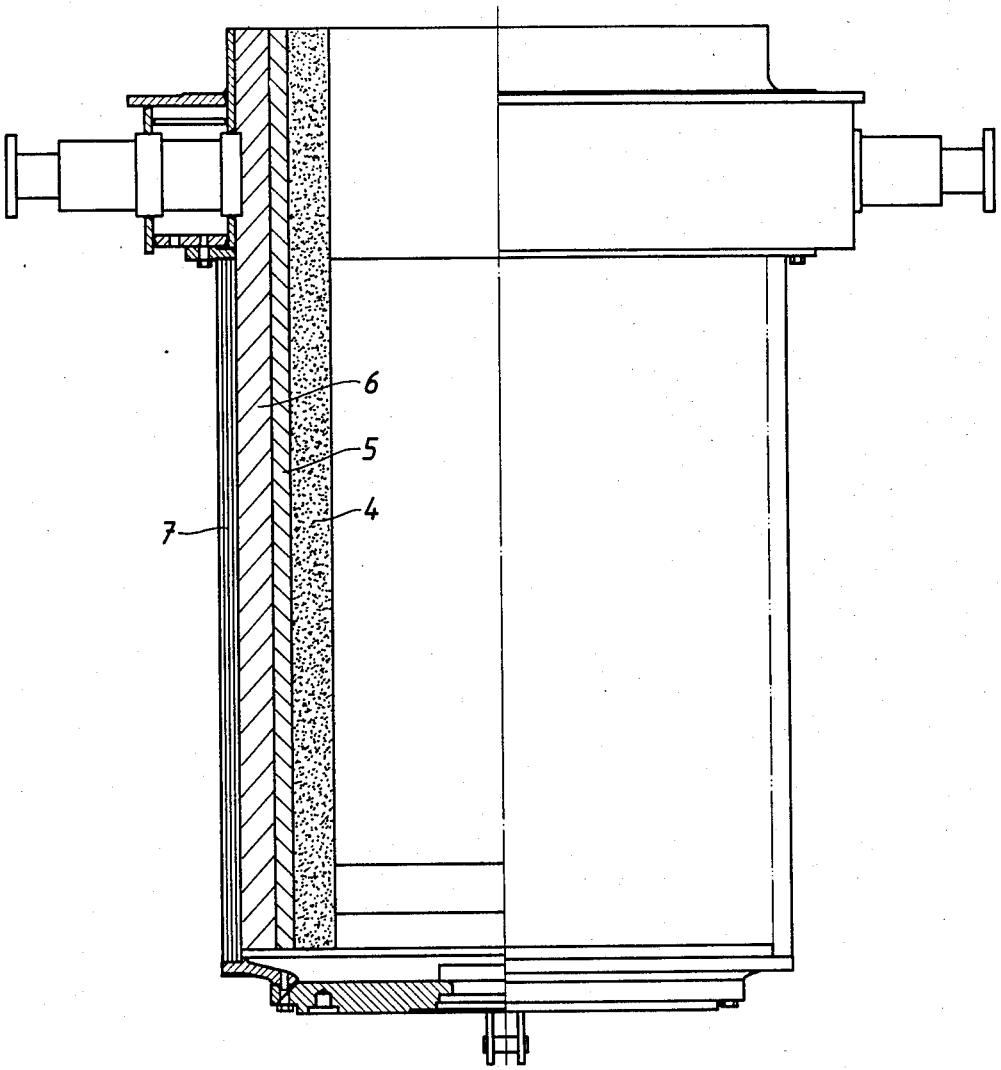
FIG. 2 is on its right-hand side in elevation and on its left-hand side in vertical section and illustrates the invention more in detail.

FIG. 2 shows the overall arrangement of the various parts. In this figure there is the usual furnace lining 4, sometimes surrounded by chamotte bricks 5 and insulating bricks 6, forming a side wall lining encircled by the previously mentioned wall 7.

Figure 3:
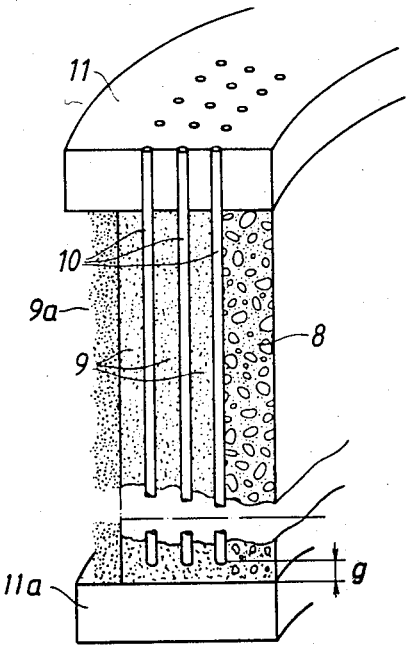
FIG. 3 on an enlarged scale shows in a vertical section segment the wall construction of the example shown by FIG. 2.

In FIG. 3 the ladle wall is shown in more detail. In this figure there is the conventional inner lining 8 externally reinforced or supported by the outer wall 9 made of concrete possibly reinforced by glass fibers, and extending down through it the axially extending wires 10 extend with their upper ends fixed to the upper steel ring 11 of the ladle but with their lower ends separated or free from the lower metal part 11*a* by gaps g so as to avoid the formation of conductive loops. Because the extents of the wires 10 are embedded in the material 9 they should have a coefficient of therman expansion substantially that of the non-metallic material 9. The wires 10 are circumferentially interspaced, may have diameters in the area of 1 to 4 mm., should preferably be non-magnetic and it is suggested that a nickel-iron based alloy wire be used, although titanium is also suitable for use. As previously mentioned, the reinforced wires should be arranged so as not to form magnetic loops, such as by providing the gaps g previously mentioned. Wherever the other drawing figures show reinforced wires it is to be understood that gaps or some other means of electrical insulation should be used to prevent the formation of the just mentioned loops.

As indicated by FIG. 3 the outside of the outer wall comprising the parts 9 and 10 is covered by a layer of fibrous insulation 9*a* such as glass fibers, adhesively fixed to the outer wall.

When the ladle or tundish contains molten steel the environmental temperature on the outside of the usual lining 13 may be around 250° C., and there may be a gradient temperature across the layer 7 of this invention in the area of 110° C., when the inside diameter of the new wall part 7 is in the area of 1 m.

Figure 5:
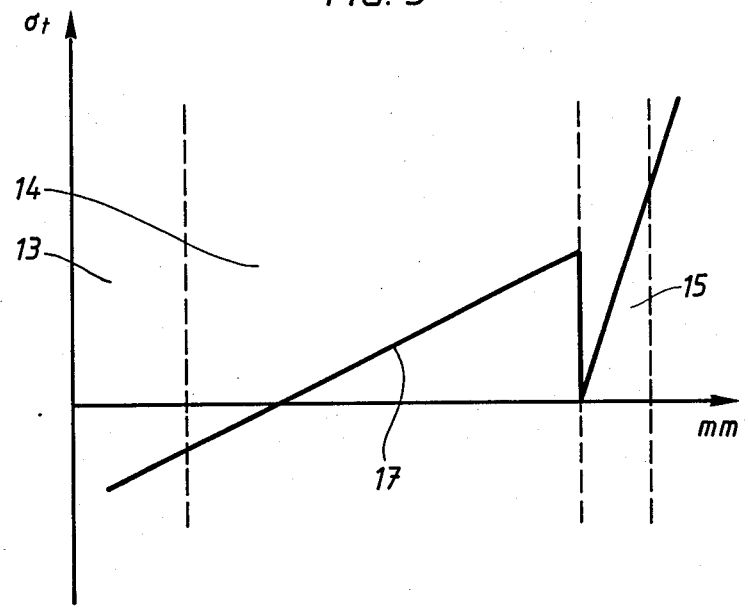
FIG. 5 is a diagram showing the tangential stress distribution through the side wall of a ladle such as shown by FIGS. 1 to 4.

With the above in mind FIG. 5 is a compression diagram of this new kind of ladle at operating temperature. 13 is the usual furnace lining, 14 is the new metal reinforced otherwise non-metallic ladle side wall and 15 is the layer of glass fibers glued to the outside of the new wall. The stress at operating temperature is indicated $\sigma_+$in MPa, and the distance from the inside surface of the wall is shown in mm. Because of the temperature gradient it can be seen that there is tangential compression applied to the lining 8 in FIG. 3, this compression being largely tangential and reducing porosity in the lining while strengthening it against possible cracking.

Figure 4:
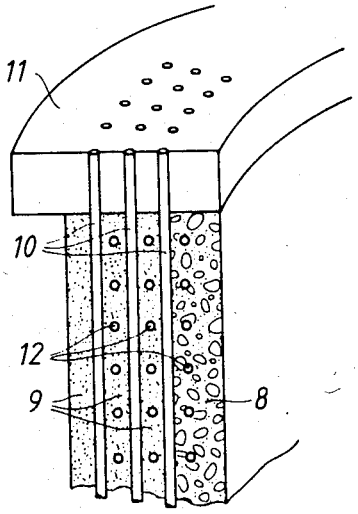
FIG. 4 is the same as FIG. 3 but shows a modification.

FIG. 4 suggests the possibility of using annularly or circumferentially extending wires 12 through the material 9 providing these do not contact the axially extending wires 10 and in each case somewhere in their circumferential extent they have gaps or other electrically insulating means. In both FIGS. 3 and 4 it is possible to use other insulating arrangements than actual gaps, providing there is some arrangement against formation of electrically conductive loops within the field of the inductive heating coil 1 shown in FIG. 1.

Figure 6:
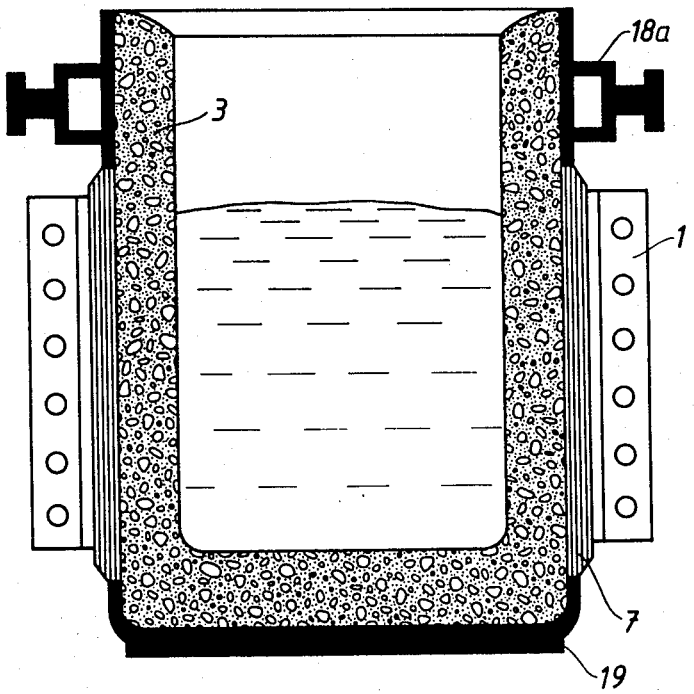
FIG. 6 is a verticle section showing a practical form of the ladle as it may be used commercially.

FIG. 6 shows how for a useable ladle there must be an upper steel collar 18 for the trunnions 18*a* and a lower bottom 19, both made of steel. This figure and FIG. 2 illustrate that all of the vertical steel reinforced wires need not be fixed to either of the upper or lower level parts. As shown in both figures, the outermost groups of wire do not abut the upper and lower annular parts and are not fixed to these parts.

What is claimed is:

1. A ladle or tundish for inductively heating molten metal in the ladle or tundish, and having a side wall formed by an inner wall of heat-insulated ladle lining compound contacted by the molten metal, and an outer concrete wall made of concrete reinforced by metal wires embeded in the concrete, the wires being electrically insulated from each other, the outer concrete wall supporting the inner wall made of the ladle lining compound.

2. The ladle or tundish of claim 1 in which said metal wires extend vertically within the concrete wall and are laterally interspaced from each other.

3. The ladle or tundish of claim 2 in which said side wall has a top and a metal ring connected to the top and said wires have upper ends fixed to the ring, the wires being free from electrical connection with each other.

4. The ladle or tundish of claim 3 in which when said inner side wall is internally heated by contact with the molten metal there is a temperature gradient from the inner wall through the side wall to the outside of said concrete wall and the inner wall is compress by the outer wall.

5. The ladle or tundish of claim 4 in which the concrete wall is further reinforced by circumferentially extending annular wires embeded within the concrete and which are interspaced and free from the vertically extending wires and have interspaced circumferential ends.

6. The ladle or tundish of claim 5 in which said concrete and wires have substantially the same thermal coefficient of expansion.

7. The ladle or tundish of claim 6 in which a refractory fibrous layer covers the outside of said concrete wall.

* * * * *